United States Patent [19]

Wolberg

[11] Patent Number: 4,801,176

[45] Date of Patent: Jan. 31, 1989

[54] COMBINATION FOLDING CHAISE AND COT

[76] Inventor: David Wolberg, 459 West St., Albany, N.Y. 12206

[21] Appl. No.: 84,393

[22] Filed: Aug. 12, 1987

[51] Int. Cl.[4] ..... A47C 4/44

[52] U.S. Cl. ..... 297/44; 5/111; 5/116; 297/45

[58] Field of Search ..... 297/42, 44, 45, 184; 5/111, 114, 116

[56] References Cited

U.S. PATENT DOCUMENTS

| | | | |
|---|---|---|---|
| 259,487 | 6/1882 | Church | 5/116 |
| 379,670 | 3/1888 | Whitehead | 297/42 X |
| 1,217,085 | 2/1917 | Clough et al. . | |
| 1,263,509 | 4/1918 | Zendt | 5/111 X |
| 1,265,848 | 5/1918 | Wheeler | 5/111 |
| 1,381,136 | 6/1921 | Ribeiro | 297/45 |
| 1,618,220 | 2/1927 | Orr | 297/45 X |
| 1,858,254 | 5/1932 | Uline . | |
| 1,977,766 | 10/1934 | Kivler . | |
| 2,121,100 | 6/1938 | Rosenbaum . | |
| 2,279,748 | 4/1942 | Deak | 297/184 X |
| 3,165,354 | 1/1965 | Egger . | |
| 3,822,422 | 7/1974 | Buntyn | 5/114 |
| 4,243,263 | 1/1981 | Thiboutot | 297/42 |
| 4,258,951 | 3/1981 | Groom . | |
| 4,437,700 | 3/1984 | Elaschuk . | |

FOREIGN PATENT DOCUMENTS

| | | | |
|---|---|---|---|
| 481907 | 2/1974 | Australia | 5/114 |
| 610132 | 3/1935 | Fed. Rep. of Germany | 297/45 |
| 2899 | 7/1904 | France | 297/45 |
| 734934 | 8/1932 | France | 297/45 |
| 339333 | 4/1936 | Italy | 5/114 |
| 6604307 | 10/1966 | Netherlands | 5/114 |

*Primary Examiner*—Peter A. Aschenbrenner
*Assistant Examiner*—Thomas A. Rendos
*Attorney, Agent, or Firm*—Schmeiser, Morelle & Watts

[57] ABSTRACT

A completely collapsible chaise-cot deriving an unique compact folding characteristic from a folding transverse foot-base support structure. The folding support structure gives an increased compactable collapsibility to this invention over the folding chairs and cots of prior inventions. Earlier art, although achieving a modicum of collapsibility for cots, lawn chairs and the like, was devoid of full and compact collapsibility because no provisions had been made by the inventors to fold the common transverse base and upper frame supporting structures. The long felt need, therefore, for a folding, completely collapsible transverse foot-base support structure has been fulfilled by this invention and the art form has achieved a new level of utility as a result.

1 Claim, 6 Drawing Sheets

COMBINATION FOLDING CHAISE AND COT

FIELD OF THE INVENTION

This invention relates to collapsible or foldable furniture items in general and, more specifically, relates to a combination chaise-cot which may be purposefully collapsed, that is, completely folded into a compact, solid, rectangular form for easy storage and carriage.

BACKGROUND OF THE INVENTION AND PRIOR ART

There are countless inventions dealing with the instant genre, some of which purport to fold combination chair-cots or other forms of furniture combined with a cot. However, an exhaustive search of patents, literature and marketplace wares has failed to disclose any individual piece of furniture, namely a chaise-cot, that can be readily folded to an optimum, truly compact ensemble. Therefore, this inventor has concluded that the most distinct (and major) disadvantage of prior and current art is that when items of the genre are collapsed or folded, the remaining package is either bulky and/or occupies an inordinate amount of space.

An invention by Egger, U.S. Pat. No. 3,165,354 issued in Jan. 1965, exemplifies the aforementioned disadvantage. This collapsible deck chair, indicative of current folding chaise art, appears to be a well thought out embodiment responding to the particular needs pointed out by its inventor. Nevertheless, when folded to its carriage structure, the collapsible deck chair becomes a rather ungainly, voluminous package. The disadvantageous folded geometry of the Egger invention is due in no small part to the fact that the collapsibility is achieved by folding an essentially longitudinal, articulated mechanism at the points of articulation. Since these points of articulation (fold) appear only along the longitudinal or body-length dimension, there is no way to close or diminish the stand-apart distances of the parallel, longitudinal frame members.

What is definitely lacking in the Egger Art was provided in some part by Groom in his invention of a collapsible chair, detailed in U.S. Pat. No. 4,258,931, which issued in 1981. Groom's invention realizes a collapsible chair, comprised of a frame with fabric suspended between portions thereof, that folds to a remarkably compact set of packages. Unfortunately, Groom's "folding" envisions a form of disassembly and, further, is directed to the collapsibility of a singular piece of furniture, not a duplex or combination such as the instant inventor's. In this regard, a patent issued in 1934 to Kivler, U.S. Pat. No. 1,977,766, appears to anticipate some of Groom's idea, but does so without disassembly, and by folding the fabric of the chair. In 1984, Elaschuk was issued U.S. Pat. No. 4,437,700, which took the Kivler art one step further. Elaschuk's invention mechanized his collapsible or folding chair idea, but with the addition of supporting struts which themselves folded by collapsing or folding away from the vertices of criss-crossing frame members. Unfortunately, like all of his predecessors, Elaschuk retained a folded package of unusual length because the invention was not framewise articulative.

Perhaps the most pertinent prior art was expressed in earlier patents issued to Clough and Spring (U.S. Pat. No. 1,217,085), Uline (U.S. Pat. No. 1,858,254) and Rosenbaum (U.S. Pat. No. 2,121,100) in 1917, 1930 and 1936, respectively. All of these inventions dealt with foldable or collapsible combination furniture items, that is, Clough and Spring folded a cot-seat, Uline folded a double chair (settee) and Rosenbaum folded a cot and duplex chair. Although the folding mechanisms of these inventions appeared at points ingenious, the user-purchaser was nonetheless left with a piece of furniture that could be folded at best to a rather clumsy, bulky package. Thus it appears, from this retrograde analysis of the prior art, that the initial problems of foldable furniture in general, and foldable duplex furniture items in particular, were with the art from its inception up to the present.

It appeared to the instant inventor that the only feasible method of constructing a truly foldable dual purposed or duplex piece of furniture such as a chaise-cot would be to fabricate a frame that was not only articulative and foldable along its lateral (longitudinal) dimension, but that would also be foldable along the transverse (cross-body) dimension. Thus, where earlier inventors were able to achieve a folded package that still retained the transverse, but diminished lateral dimensions, the instant inventor, by a novel folding of cross members and supporting struts is able to finally achieve a compact, easily carried package. But merely being able to conceive such folding along the transverse portions of the frame is not enough. In the aforementioned invention of Groom, cross body frame members are collapsed, but not without disassociating them from other fundamental elements of the invention.

To be truly functional as a chaise-cot, while being ultimately collapsible to a small compact and tidy package, the frame, exclusive of the fabric or webbing which is attached at discrete locations to certain frame members, must as earlier mentioned be foldable at the longitudinal points of articulation as well as any crosswise supports or transverse frame elements. At the points of fold, the frame members must have either inherent or purposefully mechanized locking devices. The fabric used to provide support for the reclining body must be light, strong and preferably of a ventilating webbing or netting.

SUMMARY OF THE INVENTION

An apparatus has been devised to provide a truly functional chaise-cot that may be collapsed to a small, compact and tidy package. The invention is realized by constructing a frame comprised of two elongate articulative members that are capable of being folded at the points of articulation, but in only one direction. Joining these elongate members is a fabric that is adapted to fold readily, yet be capable of sustaining the weight of a grown man. The leg members of this chaise-cot provide the truly unique character that imbues the invention with the capability of folding compactly. Leg members, at the extreme ends of the elongate frame members, are of ordinary or traditional construction in that they are devised to be unfolded and secured by detent-in-notch means, to be extended and locked perpendicular to the surface upon which the chaise-cot resides. At least two of the leg supporting members differ uniquely from the traditional construction. These members have a support structure best described as three-quarters of a transverse rectangular frame. The top member of the frame, the ostensibly missing one-quarter, is in reality provided by the fabric when the apparatus is stretched open for use. The vertical elements of the base member structure are rigid and nonfoldable, while the base element is articulative and foldable and is supported during chaise-cot usage by vertical side-to-base struts, which are also both foldable and lockable.

It should be understood that the foregoing general description cannot truly give a vivid portrayal of the invention; nonetheless, the following detailed description of the preferred embodiment shall suffice as an example and explanation of the invention, to the point of practical realization by those of ordinary skill in the art.

The accompanying drawings referred to herein and constituting a part hereof, illustrate the inventor's preferred embodiment of the invention and serve to explain the main principle of the invention, namely the uniquely foldable and lockable transverse base members.

BRIEF DESCRIPTION OF THE DRAWINGS

Of the drawings:

FIGS. 3A–3F are isometric details of an articulative folding joint of the invention;

DETAILED DESCRIPTION OF THE PREFERRED EMBODIMENT

Figure 1:
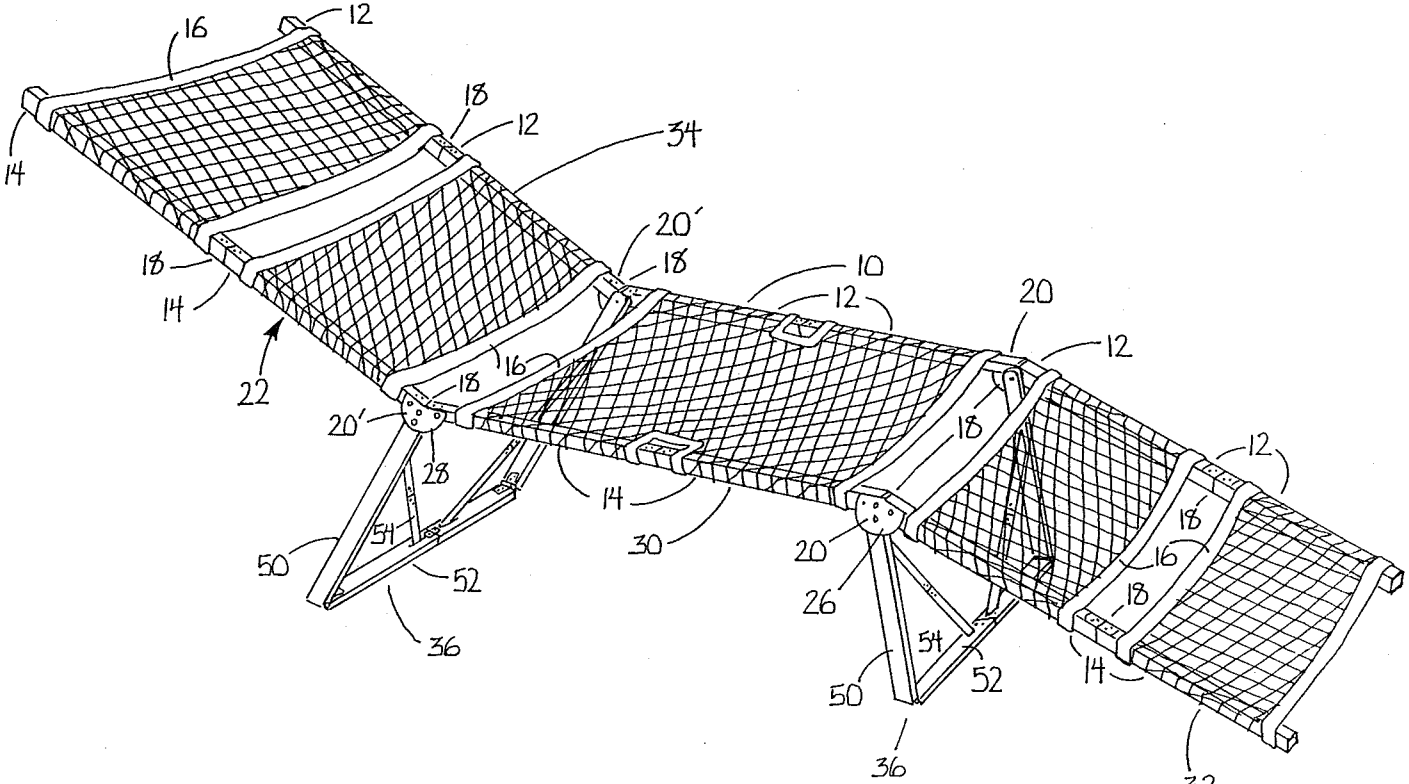
FIG. 1 is an isometric illustration of the invention in the chaise or lounge only configuration.

The first illustration, FIG. 1, displays the invention in the chaise lounge mode for clarity and in order to more definitively highlight the major elements of the invention. The chaise 10 is depicted comprised of a pair of elongate articulative members 12, 14 between which are fixed a series of flexible panels 16. In the preferred embodiment, the fabric panels 16 are composed of a strong, durable fabric such as nylon or vinyl, and may be woven. A netted panel 16 is displayed herein as such construction from the aforementioned materials, or similar compositions, may be compactly folded, yet lend a great deal of strength to the construction. The articulating-locking joints 20' lend the only asymmetrical character, (i.e., upward locking section 22 and downward locking section 24), to the invention. This is because hinge plate 26 is shaped differently than hinge plate 28, so that the respective angular registries of middle section 30 with foot section 32 and head section 34 may be locked and held to accommodate the prone, articulated body. Primary support members 36 shall be discussed more during the review of FIG. 2 which follows.

Figure 2:
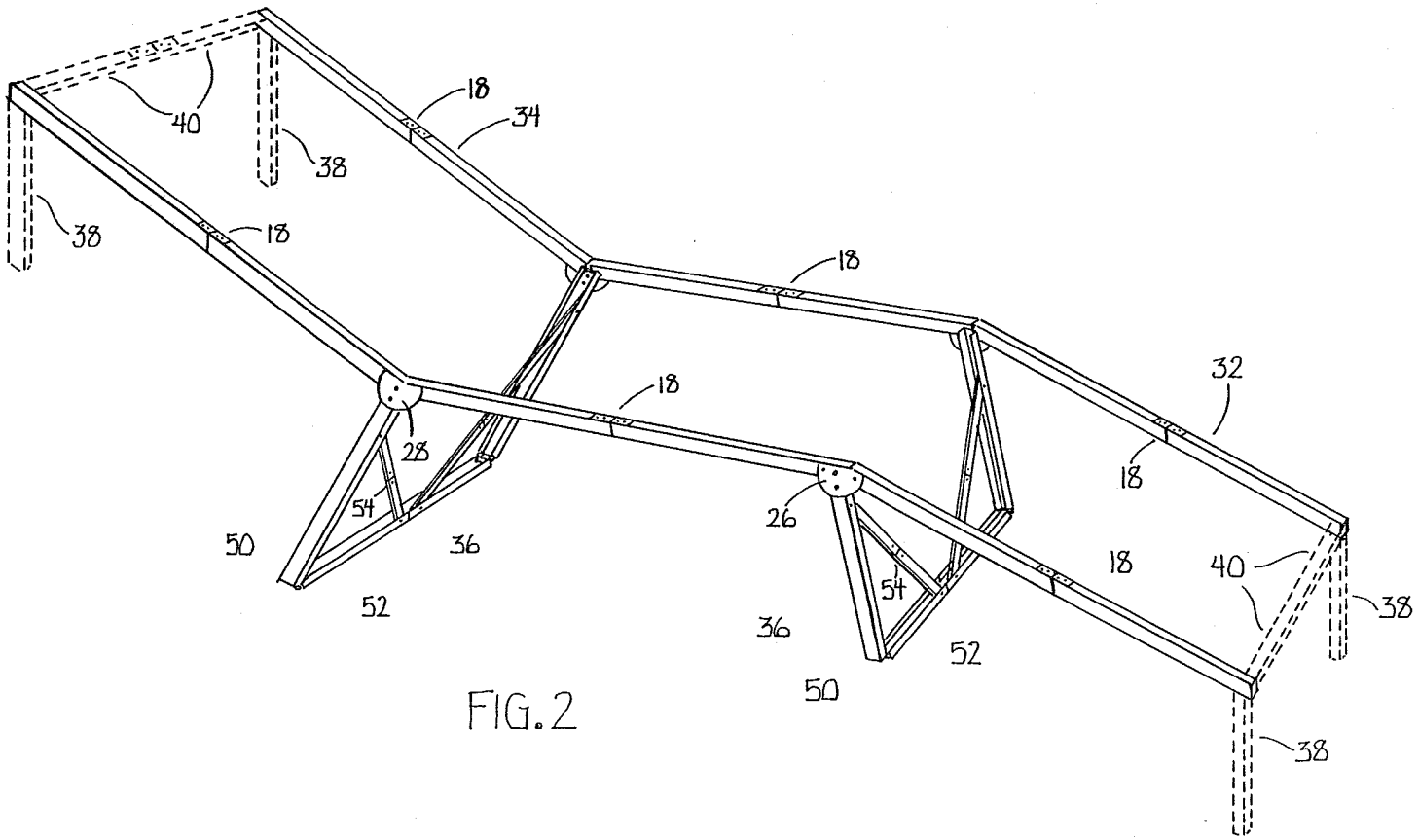
FIG. 2 is an isometric illustration of the rigid structure of the duplex invention.

In addition to the mechanism previously discussed in FIG. 1, FIG. 2 illustrates, in phantom, head legs 38 and foot legs 38' which operate identically when the invention is deployed in its cot mode. While in this mode, it can be seen that transverse supports 40 will also be employed. In this figure, wherein the fabric has been removed for the sake of clarity, the reader is better able to view plates 26 and 28 that retain the chaise or lounge mode (as depicted in FIG. 1) of the invention. In the cot mode, foot section 32 is raised above its normally locked position while head section 34 is lowered from its normally locked chaise position. Support structures 36 will be discussed in greater detail when referring to FIGS. 5A and 5B.

Figure 3A:
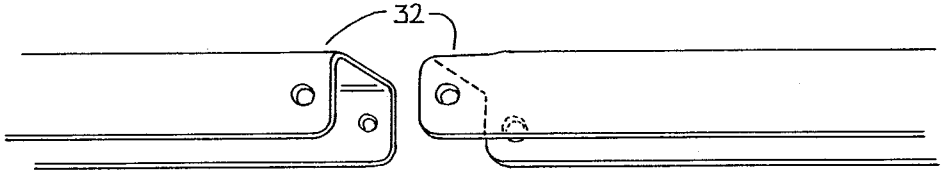
Figure 3B:
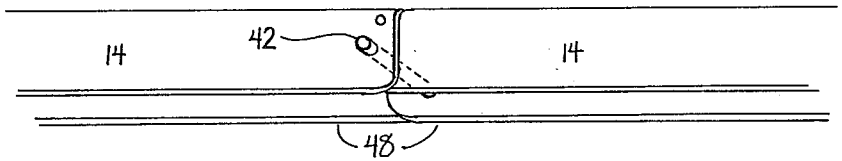
Figure 3C:
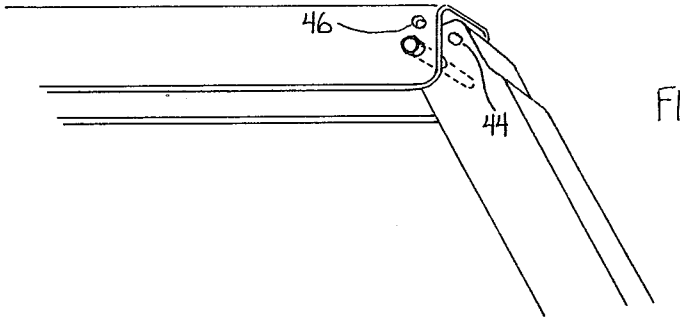
Figure 4A:
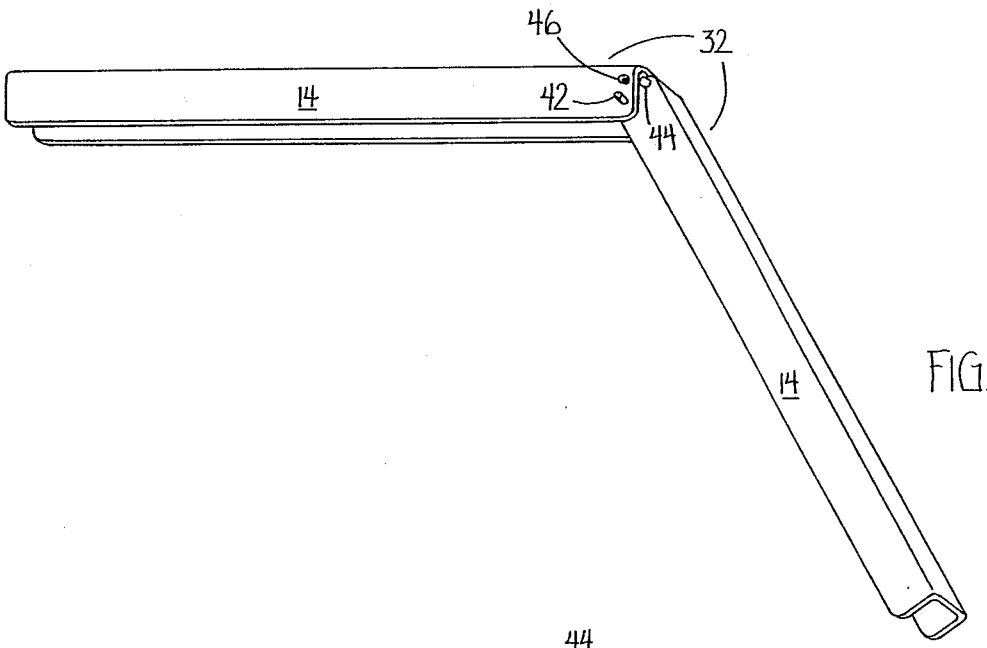
FIGS. 4A and 4B are isometric details of the locking mechanism associated with FIG. 3.
Figure 4B:
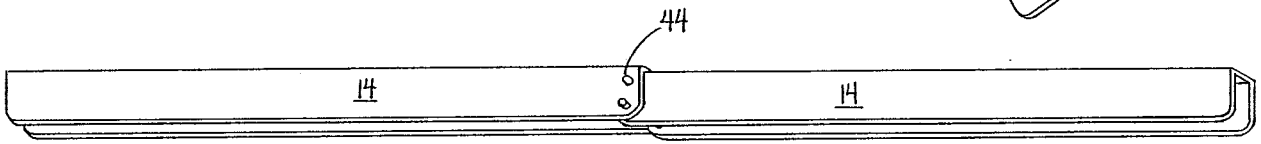

FIGS. 3(A–C) and 4(A–B) show detailed structure of articulating foot members 32. It is apparent however, that articulating members 14 all function in this fashion; and, the only distinction between them is the direction in which they fold. For example, the type of mechanism shown in FIGS. 3 and 4 would be best employed on cot version leg members 38 and 38'. A similar mechanism, i.e., hinge pin and spring-biased detent 44 for insertion in detent receiver 46 could also be used at joints 26 and 28, as disclosed in FIGS. 1 and 2. Hinge members 18 of FIG. 1 would be necessary to allow articulating members 30, 32, and 34 to fold inward. Nonetheless, hinges 18' can be employed with the detailed structure of FIG. 3 by affixing the hinges at point 48 on members 14 and removing hinge pin 42. This would allow detent-in-receptor 44, 46 to still be used with the hinge mechanism depicted in FIGS. 1 and 2. Such apparatus is, of course, well known to those versed in the art and remains a matter of inventor's or manufacturer's choice.

Figure 5B:
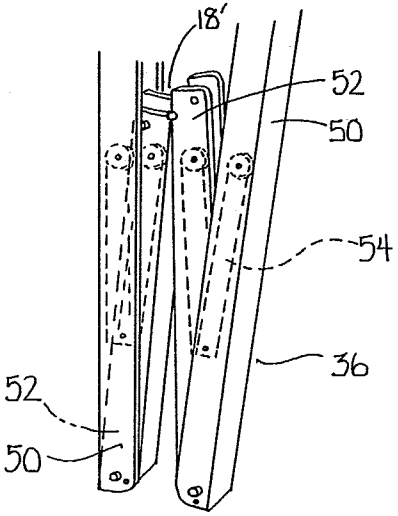
FIGS. 5A and 5B are isometric details of the foldable base leg assembly.
Figure 5A:
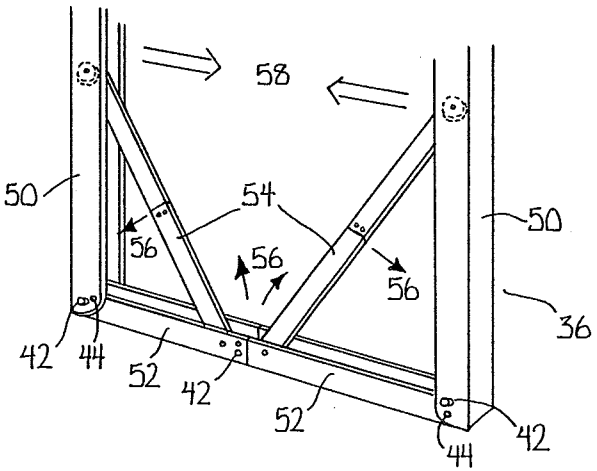

Calling the reader's attention now more particularly to FIGS. 5A and 5B, there is depicted (isometrically) the novel base support structure 36 of the invention. Vertical legs 50 are joined by the apparatus depicted in FIGS. 3 and 4, namely hinge 42 and detent 44, to bases 52. Alternatively, as mentioned earlier, hinge 18' as shown in FIG. 5B, may be used to join the bases 52. Irrespective of the hinging or jointing means employed, folding struts 54 are common to all versions of the preferred embodiment and are a required element of the footing-base structure. Solid barbed arrows 56 indicate the direction in which the footing-base structure 36 (base 52 and strut 54 elements) is folded in order to collapse the ensemble. Bar arrows 58 indicate the direction of collapse; and FIG. 5B depicts the resulting fold.

Figure 6B:
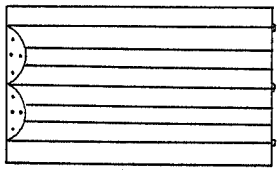
FIG. 6A and 6B are isometric illustrations depicting an entire frame of the invention of FIG. 1, folding.
Figure 6A:
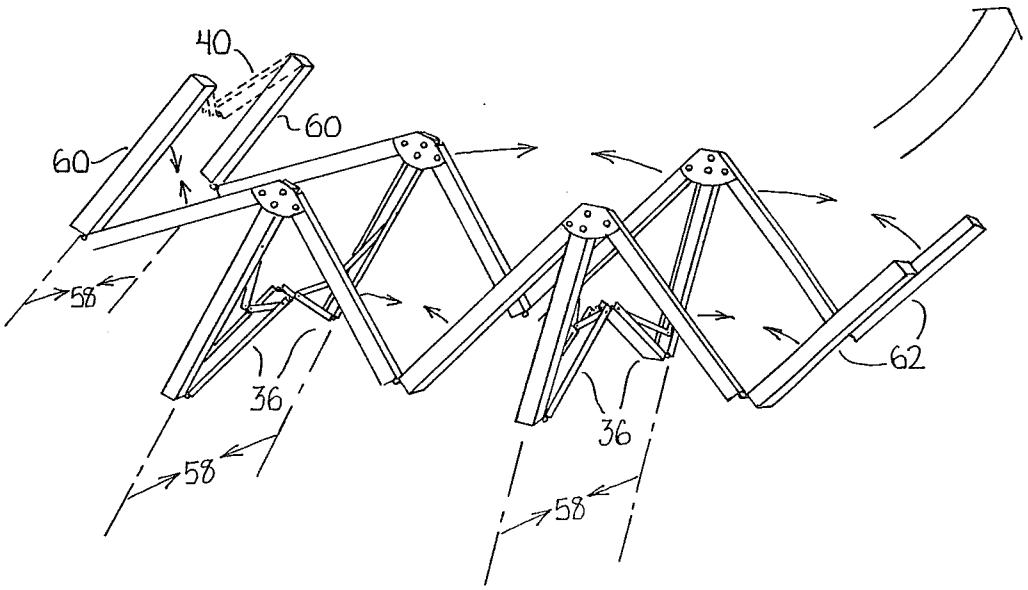

FIG. 6A is an isometric illustration sans netting or fabric 16, of the chaise version. It will be understood that the cot version folds in similar manner by folding its leg members 38, 38' (not shown) against the lower foot and head members 62, 60 shown therein. Also, cross members 40 (not shown) Would fold inward in the manner similar to footing-bases 36. The fabric, being very thin and foldable is gathered interstitially between the articulating frame, base and other support members of the invention, as it is folded.

As pointed out earlier, it is clear that the preferred embodiment may be realized utilizing several forms of folding and locking apparatus. Notwithstanding the allowability of such variations, the basic concept of the foot-base member allows the two major variations, chaise and cot, while granting the unique characteristic of complete collapsibility. Those familiar with this art will also recognize that the struts 54 may be obviated by use of rigid connectors or locks at the juncture of legs 50 and base 52. It is these principles that are intended to be secured by the following claims.

What is claimed:

1. In a compactly collapsible chaise-cot having an articulating and foldable legged rectangular frame, the improved combination comprising:

a foldable transverse frame member located at the head and at the foot of lateral members of said rectangular frame;

a set of foldable legs located at the head and foot of said frame;

a foldable netting attached transverse to the lateral members of said rectangular frame; and two unitary folding foot-base members hingably attached and transverse to said rectangular frame proximate both the head and foot regions of same, each of said foot-base members further comprising two vertical legs, a foldable ground-contacting base orthogonal to said vertical legs and hingably connected thereto, said base further comprising two ground-contacting members that interlock proximate leg and base hinges by detent-in-hole means, and a strut for additionally supporting the orthogonal relationship between said base and each of said legs, said strut having a central hingable foldable joint and that is further hinged to said base and a vertical leg and when folded collapses so that its foldable joint moves in towards the hingable connection of said vertical leg and said base, whereby folding said set of foldable legs and said foot-base members, and further folding said frame at points of articulation, and further folding said transverse frame members in predetermined directions collapses said chaise-cot, gathering said fabric interstitially between said frame, said leg and set foot-base members.

* * * * *